US006827016B2

(12) United States Patent
Kobayashi et al.

(10) Patent No.: US 6,827,016 B2
(45) Date of Patent: Dec. 7, 2004

(54) BEARER CLEANING APPARATUS

(75) Inventors: Yoshio Kobayashi, Tokyo (JP); Keiichiro Ohta, Yokohama (JP); Mutsuhito Yoneta, Tokyo (JP)

(73) Assignee: Kabushikikaisha Tokyo Kikai Seisakusho, Tokyo (JP)

( * ) Notice: Subject to any disclaimer, the term of this patent is extended or adjusted under 35 U.S.C. 154(b) by 0 days.

(21) Appl. No.: 10/426,024

(22) Filed: Apr. 30, 2003

(65) Prior Publication Data

US 2004/0000244 A1 Jan. 1, 2004

(30) Foreign Application Priority Data

Jun. 28, 2002 (JP) ..... 2002-191384

(51) Int. Cl.[7] ..... B41F 35/00
(52) U.S. Cl. ..... 101/423; 101/425
(58) Field of Search ..... 101/425, 423, 101/424; 15/256.5, 256.51, 256.52

(56) References Cited

U.S. PATENT DOCUMENTS

| | | | | |
|---|---|---|---|---|
| 4,393,778 A | * | 7/1983 | Kaneko | 101/425 |
| 4,870,900 A | * | 10/1989 | Robertson | 101/216 |
| 4,893,562 A | * | 1/1990 | Robertson | 101/425 |
| 5,704,290 A | * | 1/1998 | Metrope et al. | 101/425 |
| 6,272,988 B1 | * | 8/2001 | Garland et al. | 101/425 |

FOREIGN PATENT DOCUMENTS

| | | |
|---|---|---|
| JP | S 49-19802 | 2/1974 |
| JP | 61-144354 | 7/1986 |
| JP | H2-111527 | 9/1990 |
| JP | H2-115442 | 9/1990 |
| JP | Y2-3-24358 | 5/1991 |
| JP | 05-138873 | 6/1993 |
| JP | H7-2058 | 1/1995 |

OTHER PUBLICATIONS

GOSS Colorliner Operation Manual 415–OM: Printing Units With Digital Injector Inking System and Limited Operating Controls, p. 6–5.

* cited by examiner

*Primary Examiner*—Leslie J. Evanisko
(74) *Attorney, Agent, or Firm*—Morgan, Lewis & Bockius LLP

(57) ABSTRACT

Upon replenishing cleaning members 10 of a plurality of sets of cleaning means 1 of a cleaning apparatus with a cleaning solution, those sets of cleaning means 1 having the cleaning members 10 to be replenished, respectively, are fed with the cleaning solution from a cleaning solution supply source part 21 communicated with the plurality of sets of cleaning means 1 through supplying conduits 23 via supply branching part 22. The cleaning solution as fed out reaches the supply branching part through the supply pipe, and fed out from the supply branching part in a manner branched into the supplying conduits branched to feeding destinations, respectively, to thereby reach the plurality of cleaning members to be replenished. In this way, upon replenishing a plurality of cleaning members of a bearer cleaning apparatus with a cleaning solution, it becomes possible to replenish the plurality of cleaning members with the cleaning solution from a single location in an extremely simple manner.

11 Claims, 7 Drawing Sheets

BEARER CLEANING APPARATUS

BACKGROUND OF THE INVENTION

1. Field of the Invention

The present invention relates to a bearer cleaning apparatus for wipingly cleaning outer peripheries of bearers of a printing machine, and more particularly to a bearer cleaning apparatus for wipingly cleaning bearers' peripheral surfaces by utilizing a cleaning solution.

2. Description of the Prior Art

Bearer cleaning apparatuses for wipingly cleaning bearers' peripheral surfaces of printing machines are known, such as from: JP-Y2-3-24358 (24358/1991); and a paragraph of "BEARER WIPE OIL CUPS" in a right column on page 6-5 and "FIG. 6-2 Bearer Wiper Assembly" of the same column on the same page of "GOSS Colorliner PRINTING UNITS WITH DIGITAL INJECTOR INKING SYSTEM AND LIMITED OPERATING CONTROLS Operation Manual 415-OM".

The bearer cleaning apparatus shown in JP-Y2-3-24358 includes an elastic arm mounted on a frame, and this arm has a tip end attached with a felting-material cleaning member (wiper) via cylindrical holding member (wiper holder) formed with a lubricant hole. Further, one end of the cleaning member in this bearer cleaning apparatus is protruded from the holding member and contacted with a bearer's peripheral surface of a printing cylinder by virtue of the elastic force of the arm. The bearer cleaning apparatus having such a constitution is intended to be supplied with a cleaning solution (lubricant) through the lubricant hole as required to thereby immerse the cleaning member in the cleaning solution, so as to wipingly clean the bearer's peripheral surface while supplying the cleaning solution to the bearer's peripheral surface through the cleaning member. The printing cylinder may be shifted by 1 to 10 millimeters, for printing preparation such as mounting of a press plate. The bearer cleaning apparatus is provided with a compression spring between: the other end of the cleaning member housed within the holding member; and the inner wall of the holding member; in which the compression spring exhibits a reactive force weaker than the elastic force of the arm thereby allowing the cleaning member to follow the bearer's peripheral surface which shifts together with the printing cylinder.

Further, the bearer cleaning apparatus shown in the "Operation Manual 415-OM" of the "GOSS Colorliner" is constituted to be mounted on a finger guard provided at a nip point to be defined by a plate cylinder and a blanket cylinder. The bearer cleaning apparatus is further provided with: a cleaning member (wiper) having one end contacted with a bearer's peripheral surface; and an oil cup adjacent to the other end of the cleaning member. The bearer cleaning apparatus is constituted such that the cleaning member is supplied with a cleaning solution (lubricant) from the oil cup to thereby wipingly clean the bearer's peripheral surface while supplying the cleaning solution to the bearer's peripheral surface through the cleaning member.

Meanwhile, each one of the above-mentioned known bearer cleaning apparatuses is individually provided with means for supplying the cleaning solution to the associated cleaning member. This obliges an operator to go up to the position of each cleaning apparatus so as to replenish each cleaning member or each oil cup with the cleaning solution, when the cleaning member requires the cleaning solution. This results in an extremely inefficient cleaning operation, and obliges the operator to conduct an extremely troublesome, much burdened and complicated operation. Particularly, in such a web press constituted of a plurality of longitudinally or vertically overlapped printing parts and capable of conducting multi color printing and which web press is recently practiced such as in newspaper printing, the respective printing parts are not placed in the same floor so that the operator is obliged to go up and down among different floors in case of replenishing each cleaning member or each oil cup with a cleaning solution. This results in a further increased physical burden of such a cleaning operator.

SUMMARY OF THE INVENTION

It is therefore an object of the present invention to provide a bearer cleaning apparatus for wipingly cleaning bearers' peripheral surfaces by utilizing a cleaning solution, for enabling to replenish a plurality of cleaning members with the cleaning solution from a single location in an extremely simple manner upon replenishing the cleaning members with the cleaning solution, thereby achieving an improved working efficiency and excluding a burden of an operator, to thereby release the operator from troublesome and complicated operations.

To achieve the above object, the present invention provides a bearer cleaning apparatus provided correspondingly to bearers provided at both ends, respectively, of a printing cylinder of a printing machine, the apparatus comprising: a plurality sets of cleaning means supported in a manner capable of contacting with bearers' peripheral surfaces, respectively; and cleaning solution supplying means for supplying a cleaning solution to cleaning members of the plurality sets of cleaning means. The cleaning solution supplying means comprises: a supply source part of the cleaning solution; a supply branching part of the cleaning solution; and supplying conduits leading from the supply source part via the supply branching part up to the plurality sets of cleaning means, respectively.

According to this constitution, upon replenishing cleaning members of the plurality sets of cleaning means of the cleaning apparatus with the cleaning solution, those sets of cleaning means having the cleaning members to be replenished, respectively, are fed with the cleaning solution from the cleaning solution supply source part communicated with the plurality sets of cleaning means through supplying conduits via supply branching part. The cleaning solution as fed out reaches the supply branching part through the supply pipe, and fed out from the supply branching part in a manner branched into the supplying conduits branched to feeding destinations, respectively, to thereby reach the plurality of cleaning members to be replenished.

Preferably, it is desirable for the bearer cleaning apparatus of the present invention to further comprise: a supplying pump as the supply source part, the supplying pump being provided with a cleaning solution reservoir; wherein the supply branching part comprises a distributing valve, and wherein the supplying conduits are constituted of: a main pipe leading from the supplying pump to the distributing valve; and branch pipes extending from the distributing valve in the downstream directions, respectively.

According to this constitution, the cleaning solution reserved in the cleaning solution reservoir is forcibly fed out by the pump, and the cleaning solution fed out by the pump reaches the distributing valve and is branched by the distributing valve to a plurality of outlets of the distributing valve such that substantially equal amounts of the cleaning solution are discharged from the outlets, respectively, in a manner that the cleaning solution is simultaneously replenished to those cleaning members of the plurality sets of cleaning means to be replenished via supplying conduits coupled to the outlets, respectively.

Preferably, it is desirable for the bearer cleaning apparatus of the present invention that at least the downstream-most portions of the branch pipes are capable of flexibly bending.

According to this constitution, the branch pipe never obstructs a displaced movement of the cleaning means, such as when a printing cylinder is slightly and displacedly moved for printing preparation so that the cleaning means corresponding to the printing cylinder is correspondingly required to be slightly displaced.

Preferably, it is desirable for the bearer cleaning apparatus of the present invention that the distributing valve is of a plunger-pump type constituted such that each plunger is moved to thereby discharge, from the associated one of outlets, such an amount of cleaning solution corresponding to the moved stroke of the plunger.

This constitution causes each outlet to permanently discharge a constant amount of cleaning solution.

Preferably, it is desirable for the bearer cleaning apparatus of the present invention that the distributing valve is incorporated therein with three cylinder portions each incorporated therein with a plunger, and two of the three sets of plungers and cylinder portions include the same shape plungers each having stepped portions at two locations, and the remaining one of the three sets includes a plunger having stepped portions at three locations.

This constitution causes the cylinders and plungers to mutually cooperate and causes each outlet to permanently discharge a constant amount of cleaning solution.

Preferably, it is desirable for the bearer cleaning apparatus of the present invention that each of the plurality sets of cleaning means is provided with a cleaning member constituted to be stably urged against a bearer to be wipedly cleaned, by force applying means.

This enables bearer cleaning without nonuniformity, since the cleaning means is stably urged against the bearer to be cleaned, by the force applying means.

Preferably, it is desirable for the bearer cleaning apparatus of the present invention that the cleaning means is mounted on a mounting seat disposed above a supporting member via angle bracket of the force applying means.

The force applying means is mounted to the mounting seat via angle bracket, thereby enabling permanently stabilized bearer cleaning.

Preferably, it is desirable for the bearer cleaning apparatus of the present invention that the angle bracket has an L-shape arranged to include a long edge having a downwardly directed tip end and a short edge projected oppositely to the supporting member, and the angle bracket is mounted to both of the supporting member and the mounting seat.

The angle bracket has the L-shape for achieving a sufficient rigidity, thereby enabling permanently stabilized bearer cleaning.

Preferably, it is desirable for the bearer cleaning apparatus of the present invention that the short edge of the angle bracket is formed with a pair of holes penetrating through the short edge parallelly to the long edge at positions slightly separated from the long edge, and these holes are inserted with a pair of shafts of the force applying means.

The pair of shafts of the force applying means are inserted through the holes provided at that short edge side of the angle bracket which has a higher rigidity, thereby enabling stabilized bearer cleaning.

Preferably, it is desirable for the bearer cleaning apparatus of the present invention that the pair of shafts have upper ends mutually coupled by a plate so that the pair of shafts are disposed to smoothly move when the pair of parallel shafts are upwardly and downwardly operated, and the shafts have lower ends fixed with an L-shaped block by means of setscrews.

The pair of parallel shafts smoothly move when the pair of parallel shafts are upwardly and downwardly operated, thereby enabling permanently stabilized bearer cleaning.

Preferably, it is desirable for the bearer cleaning apparatus of the present invention that, between the lower surface of the short edge of the angle bracket and the upper surface of the short edge of the L-shaped block, the pair of shafts of the force applying means are fitted with compression springs thereon, respectively, of urging means for urging the cleaning member onto the outer periphery of the plate cylinder bearer PB.

The force for urging the cleaning member onto the plate cylinder bearer is stabilized by the compression springs of the urging means, so that the film thickness of the cleaning solution on the bearer's peripheral surface is kept substantially constant. Additionally, the compression springs are capable of automatically putting out the cleaning member toward the plate cylinder bearer PB, such as by an amount of wear of the tip end of the cleaning member comprising a felting-material having a suitable thickness, when the tip end has been worn.

BRIEF DESCRIPTION OF THE DRAWINGS

The foregoing and other features of the present invention will become apparent to those skilled in the art to which the present invention relates from reading the following description with reference to the accompanying drawings, in which.

DETAILED DESCRIPTION OF THE PREFERRED EMBODIMENT

Figure 1:
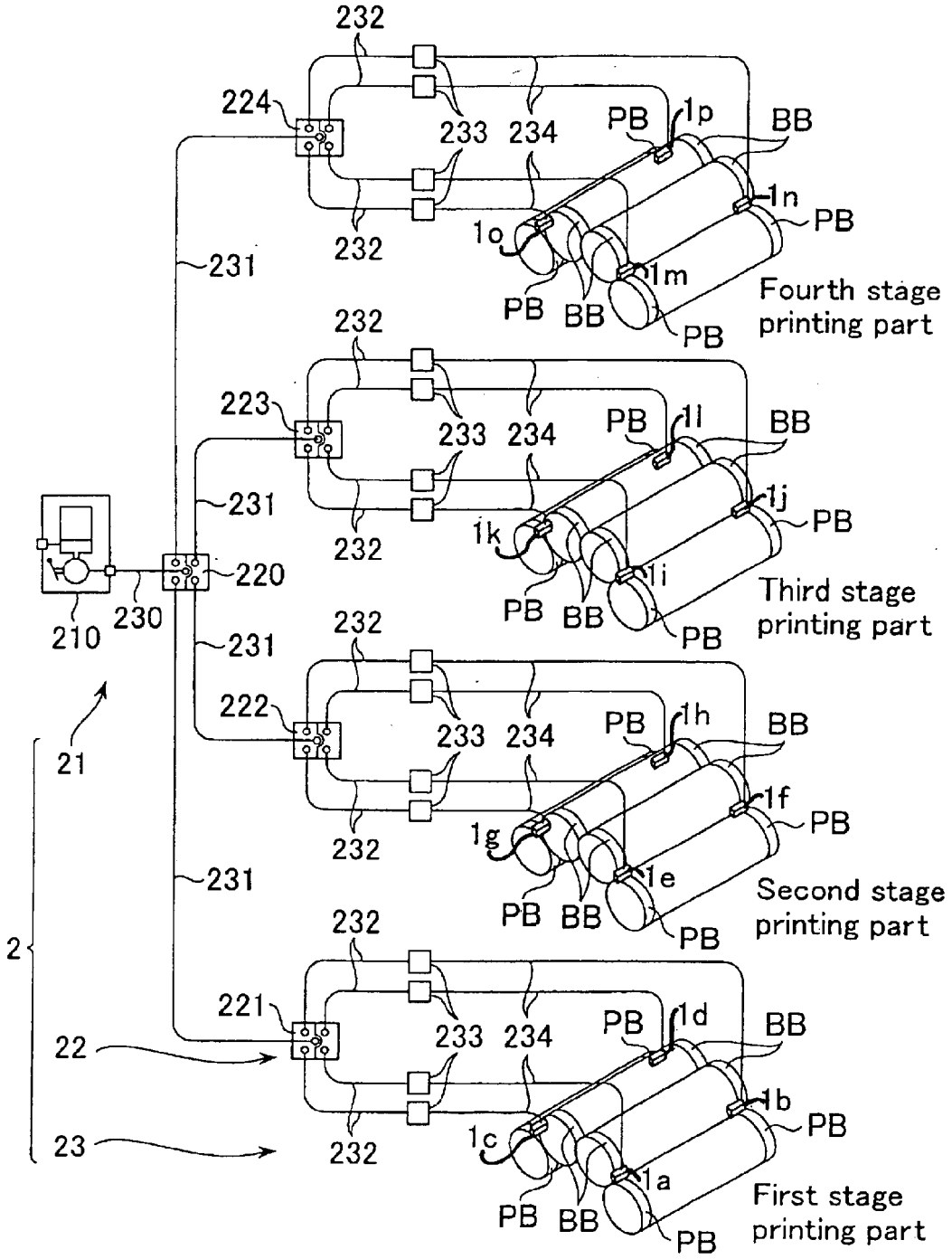
FIG. 1 is a schematic constitutional view showing a whole of an embodiment of the present invention, and mainly showing a schematic constitution of cleaning solution supplying conduits.

There will be explained hereinafter a preferred embodiment relating to a bearer cleaning apparatus of the present invention. In the preferred embodiment shown in the drawings, the bearer cleaning apparatus includes a plurality sets of cleaning means 1 (1*a* through 1*p*) (FIG. 1 and FIG. 2) and cleaning solution supplying means 2 (FIG. 1). Each cleaning means 1 is provided with a cleaning member 10, and the cleaning solution supplying means 2 is provided with a supply source part 21, supply branching parts 22 and supplying conduits 23. The cleaning member 10 of each cleaning means 1 is constituted to be stably urged against a bearer to be wipedly cleaned, by force applying means 3 (FIG. 4) to be explained later.

Figure 2:
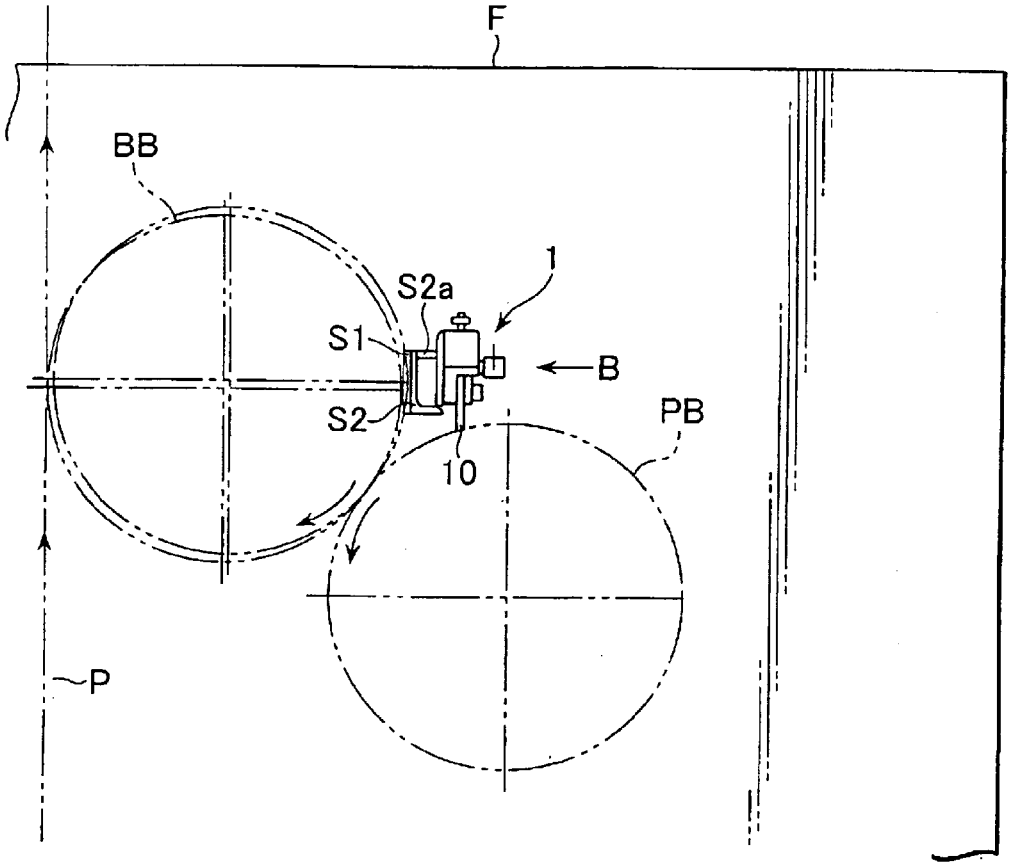
FIG. 2 is an enlarged front view showing cleaning means (such as cleaning means 1*b* at a first stage printing part) positioned rightward of a running paper sheet in the preferred embodiment of FIG. 1, together with a blanket cylinder bearer and a plate cylinder bearer.
Figure 3:
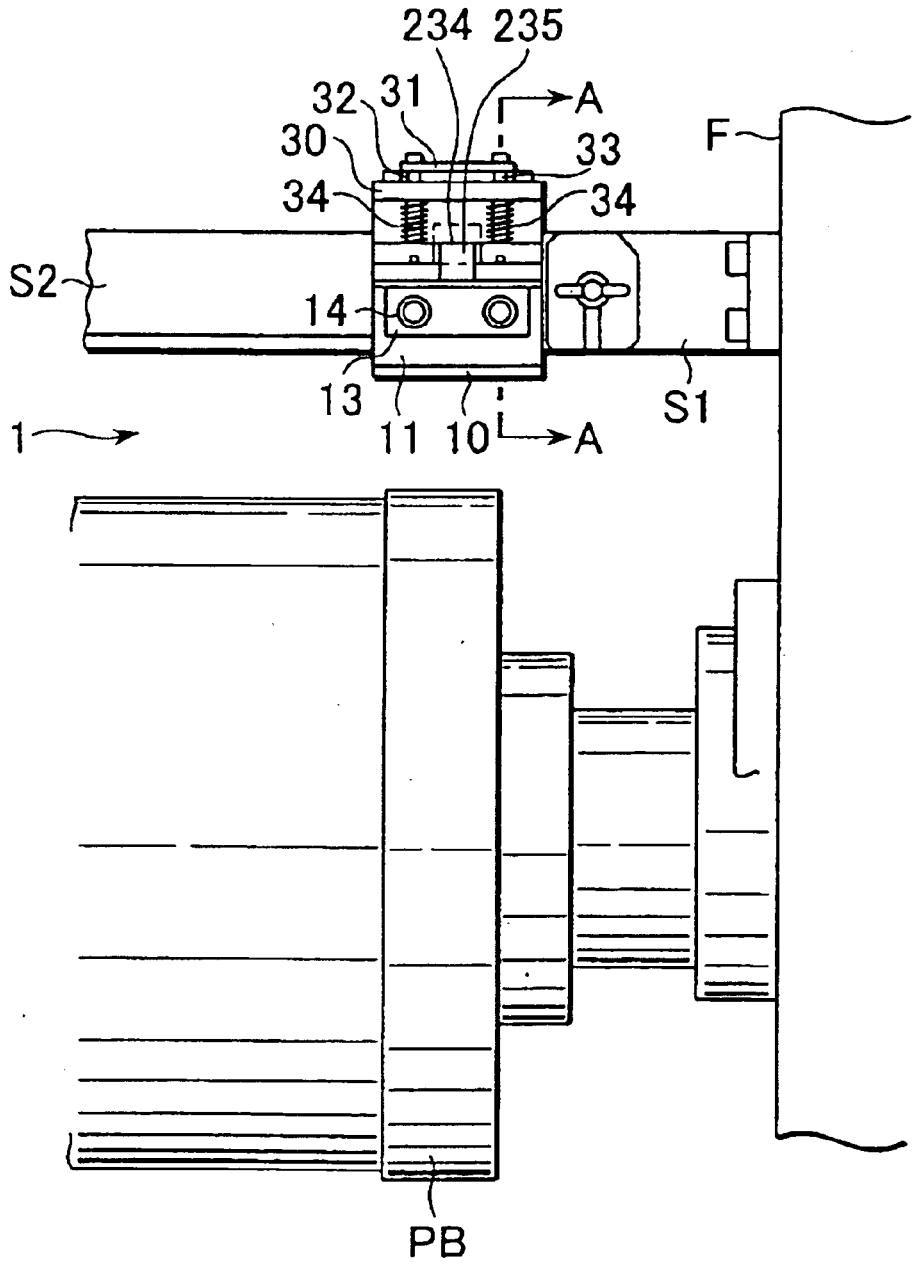
FIG. 3 is an enlarged developed view from an arrow B of bearer cleaning means of the preferred embodiment of FIG. 2.
Figure 4:
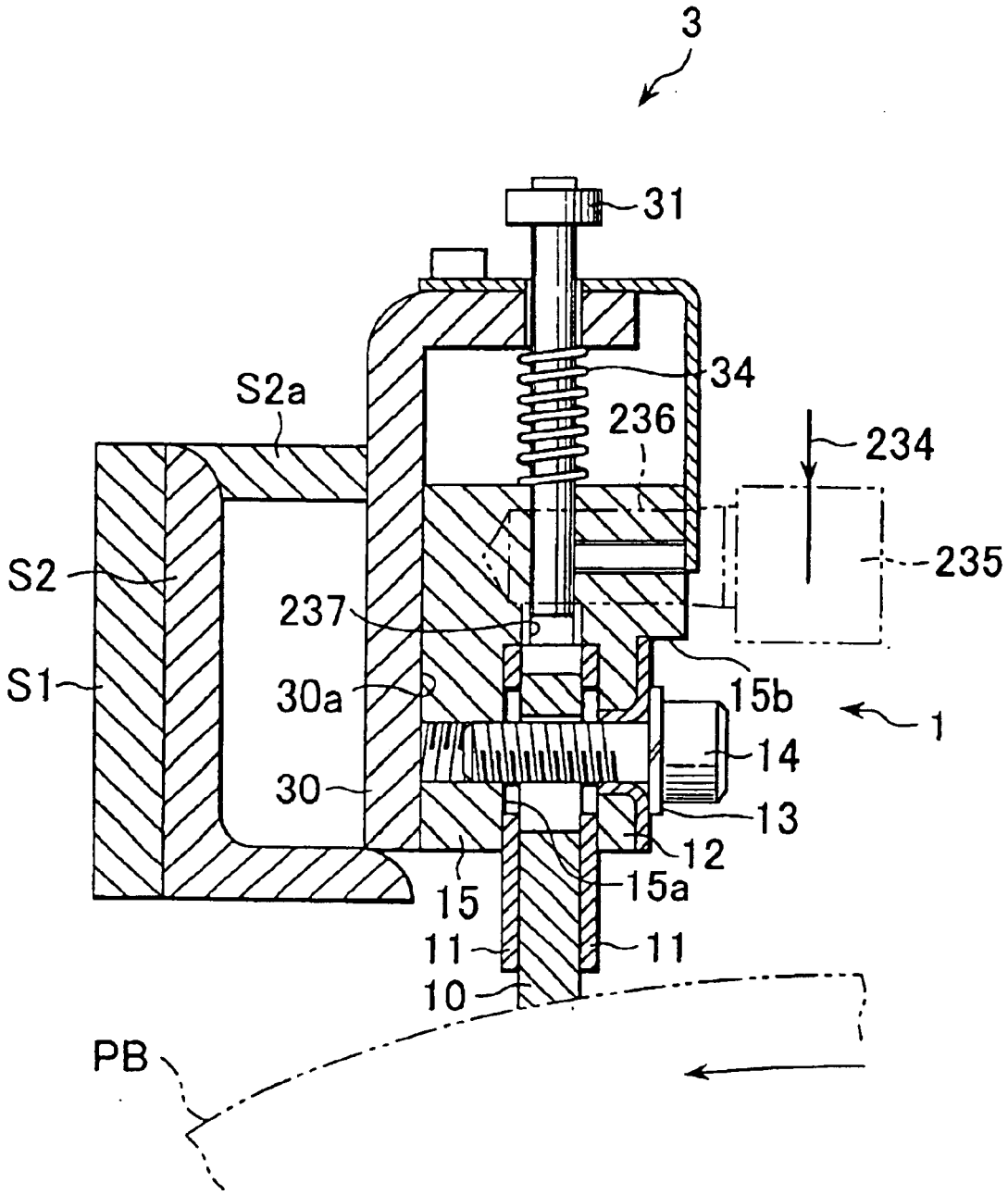
FIG. 4 is a cross-sectional view of the bearer cleaning means of the preferred embodiment of FIG. 2 and taken along an arrow A—A of FIG. 3.
Figure 5A:
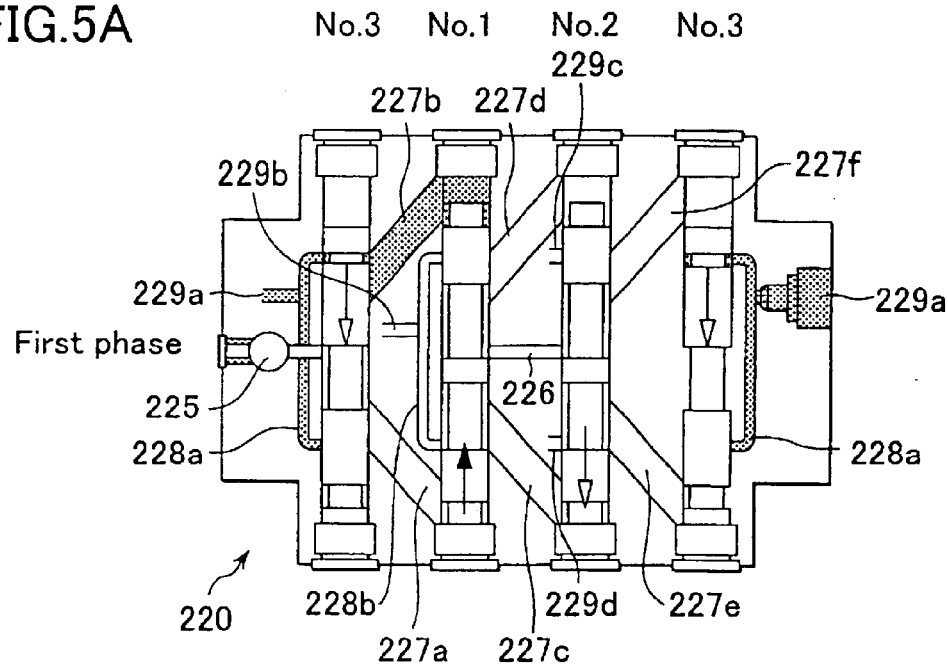
FIGS. 5A–5B are explanatory views for explaining that substantially equal amounts are discharged, respectively, by a distributing valve of a supply branching part of FIG. 1.
Figure 5B:
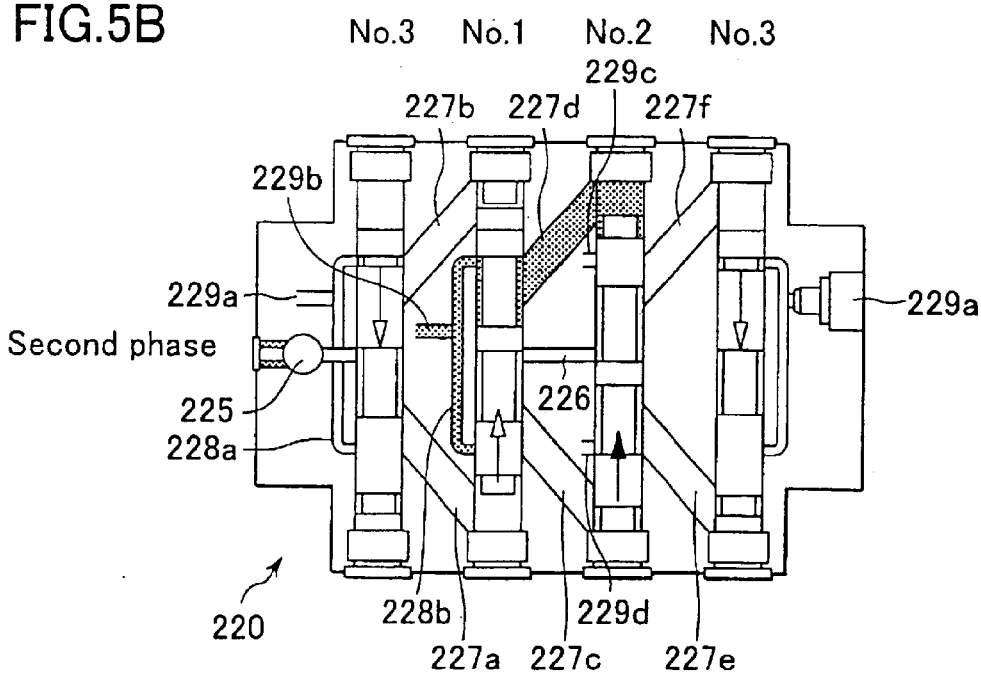
Figure 6A:
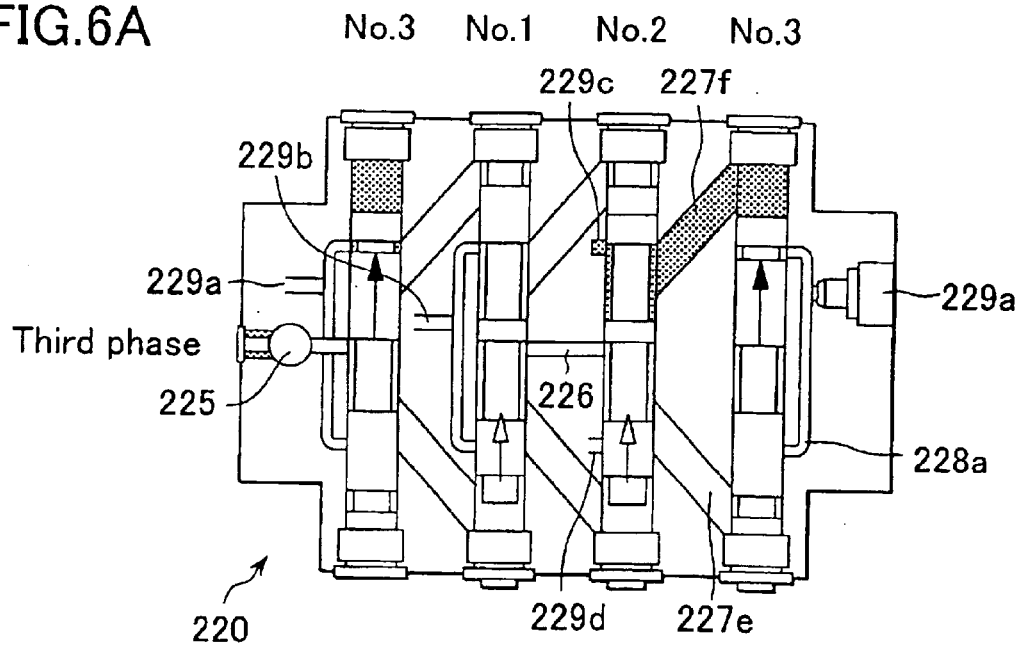
FIGS. 6A–6B are explanatory views for explaining the discharge of the distributing valve after FIG. 5.
Figure 6B:
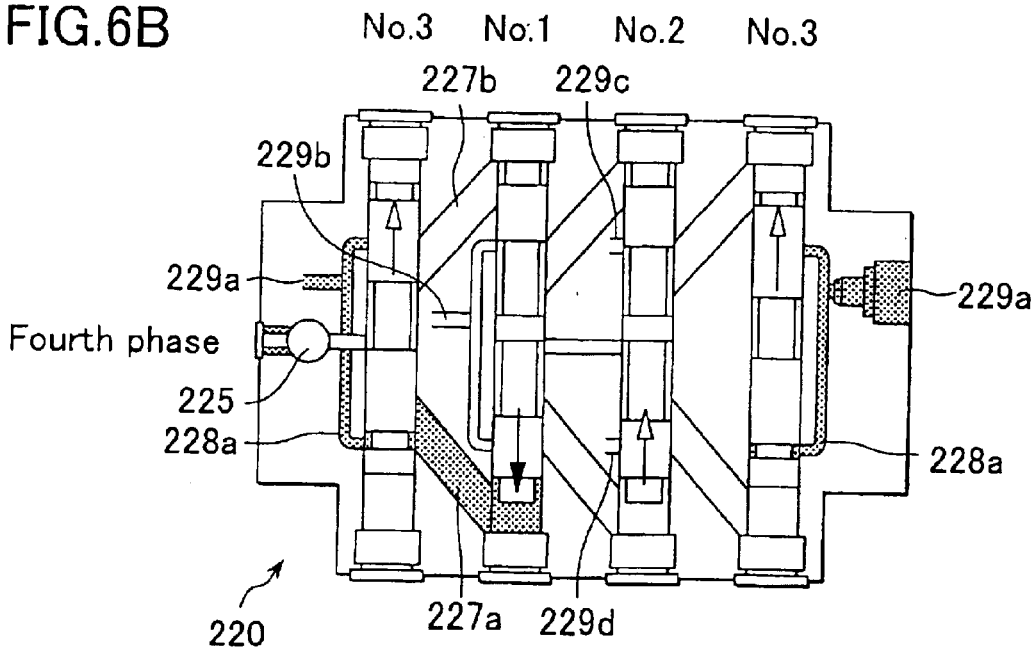
Figure 7A:
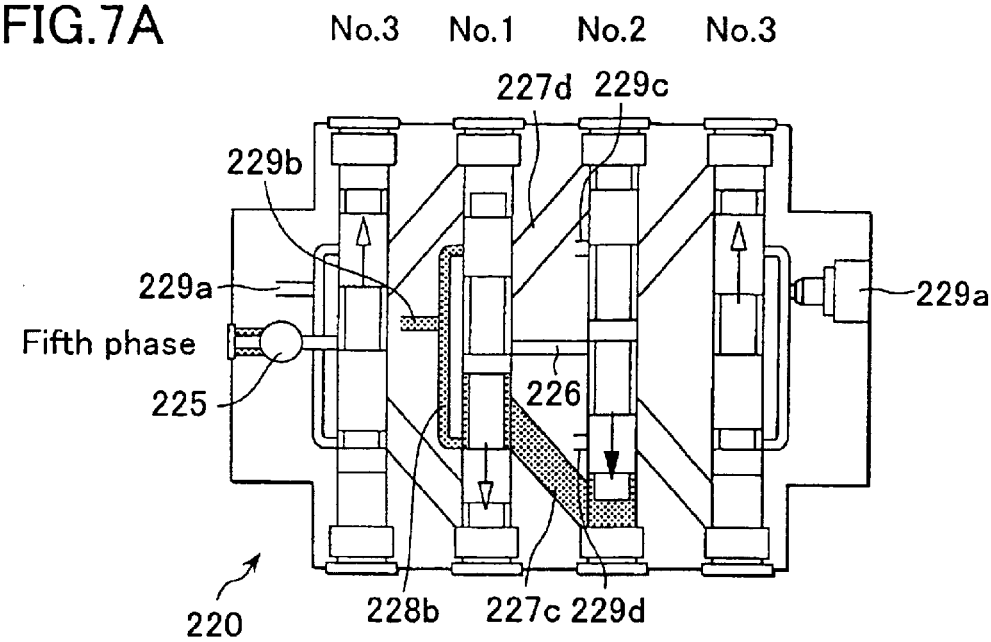
FIGS. 7A–7B are explanatory views for explaining the discharge of the distributing valve after FIG. 6.
Figure 7B:
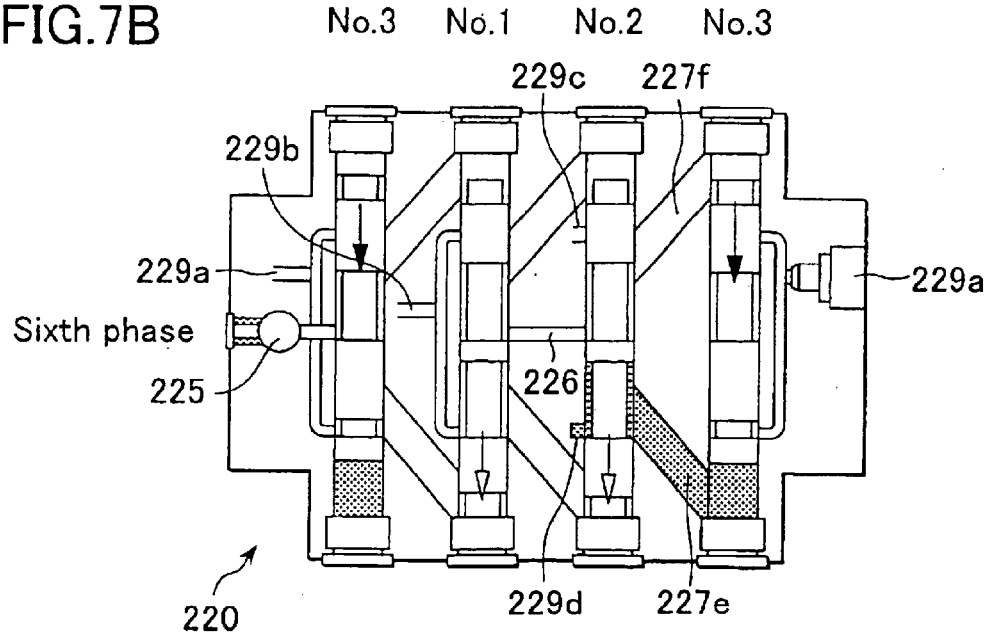

As shown in FIG. 1, the cleaning means 1 (1*a* through 1*p*) of the bearer cleaning apparatus according to the preferred embodiment of the present invention are provided correspondingly to plate cylinder bearers PB provided at both ends of plate cylinders, respectively. As shown in FIGS. 2, 3 and 4, each cleaning means 1 is mounted on a mounting seat S2*a* (shown in FIG. 2 and FIG. 4) provided on a supporting member S2 mounted to a frame F via mounting member S1, in which the supporting member S2 is placed at a position for the plate cylinder bearers PB and at an opposite side to a blanket cylinder bearer BB (shown in FIG. 2 only). The mounting seat S2*a* is disposed in a manner that the cleaning member 10 has a tip end orientation following a forward direction of the plate cylinder rotation around a plate cylinder center, thereby avoiding an occurrence of microvibration due to rotation of the plate cylinder.

FIG. 2 and FIG. 3 schematically show ones of printing cylinder bearers comprising plate cylinder bearers PB and blanket cylinder bearers BB to be installed in a left-right symmetric manner.

As shown in FIGS. 2 and 3, both ends (only one side is shown) of each supporting member S2 are mounted to the frame F via mounting member S1, so as to be positioned at an in-running nip to be defined by the plate cylinder and blanket cylinder.

Each cleaning means 1 is mounted, via angle bracket 30 (FIG. 3) of the force applying means 3, on the mounting seat S2*a* provided above the supporting member S2, to thereby attain the above-mentioned posture of the cleaning member 10. The angle bracket 30 has an L-shape arranged to include a long edge having a downwardly directed tip end and a short edge projected oppositely to the supporting member S2, and the angle bracket 30 is mounted to both of the supporting member S2 and mounting seat S2*a* (FIG. 2). As shown in FIGS. 3 and 4, the short edge of the angle bracket 30 is formed with a pair of holes penetrating through the short edge at positions slightly separated from the long edge in a manner parallel to the long edge, and these holes are inserted with a pair of shafts 32, 33 of the force applying means 3, respectively. The pair of shafts 32, 33 have upper ends coupled through a plate 31, and are disposed to smoothly move when the pair of shafts 32, 33 are upwardly and downwardly operated. The shafts 32, 33 have lower ends fixed with an L-shaped block 15 (FIG. 4) by means of setscrews.

Namely, the L-shaped block 15 is so arranged that its short edge is upwardly placed and projected oppositely to the angle bracket 30, and the short edge of the L-shaped block 15 is formed with a pair of holes which are parallel to the long edge of the L-shaped block 15 and which are fitted with the shafts 32, 33 of the force applying means 3 as shown in FIG. 4. The L-shaped block 15 is fitted with the shafts 32, 33 through the pair of holes provided at the short edge of the L-shaped block 15 and the L-shaped block 15 is fixed by setscrews, in a state where that side surface of the L-shaped block 15, which is reverse to the projecting short edge of the L-shaped block 15, is contacted with that sliding surface 30*a* of the long edge of the angle bracket 30, from which the short edge of the angle bracket 30 is projected. On that surface of the long edge of the L-shaped block 15 which is opposite to the surface contacting with the sliding surface 30*a* of the angle bracket 30, there is provided amounting surface 15*a* for mounting the cleaning member 10 thereon interposed between support plates 11, 11.

Between the lower surface of the short edge of the angle bracket 30 and the upper surface of the short edge of the L-shaped block 15, the pair of shafts 32, 33 of the force applying means 3 are fitted with compression springs 34 thereon, respectively, of urging means for urging the cleaning member 10 onto the outer periphery of the plate cylinder bearer PB. The compression springs 34 of the urging means serve to stabilize the force for urging the cleaning member 10 onto the plate cylinder bearer PB so that the film thickness of the cleaning solution on the bearer's peripheral surface is kept substantially constant. Additionally, the compression springs 34 are capable of automatically putting out the cleaning member 10 toward the plate cylinder bearer PB, such as by an amount of wear of the tip end of the cleaning member 10 comprising a felting-material having a suitable thickness, when the tip end has been worn.

At an opposite side to the angle bracket 30, the long edge side of the L-shaped block 15 is mounted with the cleaning member 10 in a state that the tip end of the cleaning member 10 of the cleaning means 1 is directed toward the outer periphery of the plate cylinder bearer PB. Meanwhile, the short edge side end of the L-shaped block 15 is formed with: a piping hole 236 mounted with an angled elbow 235 coupled to a flexible bending pipe 234 of the supplying conduit 23; and a cleaning solution supplying hole 237 opened downwardly toward a tail end of the cleaning member 10.

The upper ends of the support plates 11, 11 are higher than the upper end of the cleaning member 10, thereby preventing the cleaning solution supplied via cleaning solution supplying hole 237 from passing along the upper surface of the cleaning member 10 to thereby leak toward the head direction of a bolt 14. There is further provided a seizing plate 12 having an upper end higher than the upper end of the support plate 11 at the head side of the bolt 14 in a manner to be overlapped with this support plate 11, and the lower surface of the short edge of the L-shaped block 15 is formed with a cut-out 15b so that the upper end of the seizing plate 12 is upwardly projected and overlapped with the cut-out.

Mounted to the mounting surface 15*a* at the long edge side of the L-shaped block 15 is the cleaning member 10 interposed between the support plates 11, 11 such that the cleaning member 10 is immovably seized by the bolt 14 via seizing plate 12 and retaining washer 13 in the above-mentioned manner. Note, the cleaning member 10 is positionally adjustable, by means of long holes provided in the support plates 11, 11 and cleaning member 10. The support plates 11, 11 also serve as reinforcing members for preventing the cleaning member 10 from being deformed due to a load.

FIG. 1 is a schematic constitutional view of cleaning solution supplying paths from the cleaning solution supply source part 21 up to the cleaning means 1 (1*a* through 1*p*) in a rotary press comprising 4-fold stacked printing parts for double-face multi color printing onto a running paper sheet. Shown at the right side of this figure is the printing machine provided with four printing parts disposed in the vertical direction, in which each printing part includes two pairs of printing cylinders and each pair consists of the plate cylinder and blanket cylinder. The running paper sheet is shown in FIG. 2 by a reference character P.

The cleaning solution supplying means 2 comprises the supply source part 21, supply branching parts 22 and supplying conduits 23, and the supplying conduits 23 are coupled to the plurality sets of cleaning means 1 (1*a* through 1*p*) from the supply source part 21 via supply branching parts 22.

The supply source part 21 exemplarily comprises a supplying pump 210 provided with a cleaning solution reservoir. The supply branching part 22 exemplarily comprises a distributing valve 220. Suppliedly piped between the supplying pump 210 and distributing valve 220 is a main pipe 230. The distributing valve 220 includes four ports suppliedly piped into four directions of a distributing valve 221 of the first stage printing part, a distributing valve 222 of the second stage printing part, a distributing valve 223 of the third stage printing part and a distributing valve 224 of the fourth stage printing part, respectively, which distributing valves are provided correspondingly to the stages of the 4-fold stacked printing parts, respectively. The distributing valve 220 and the distributing valve 221 at the first stage printing part are suppliedly piped therebetween with a branch pipe 231. Similarly, the distributing valve 220 and the distributing valve 222 at the second stage printing part, the distributing valve 220 and the distributing valve 223 at the third stage printing part, and the distributing valve 220 and the distributing valve 224 at the fourth stage printing part are suppliedly piped therebetween with branch pipes 231, respectively.

Each of the distributing valve 221 at the first stage printing part, the distributing valve 222 at the second stage printing part, the distributing valve 223 at the third stage printing part and the distributing valve 224 at the fourth stage printing part is a 4-port distributing valve, and is suppliedly piped into four directions. The ports of the distributing valve 221 at the first stage printing part and piping blocks 233 are suppliedly piped therebetween with branch pipes 232, respectively. Similarly, the ports of the distributing valve 222 at the second stage printing part, the distributing valve 223 at the third stage printing part and the distributing valve 224 at the fourth stage printing part and the associated piping blocks 233 are suppliedly piped therebetween with branch pipes 232, respectively. Further, the branch pipe between each piping block 233 and each associated cleaning means 1 is suppliedly piped as the flexible bending pipe 234. Namely, the flexible bending pipes 234 couple between the piping blocks 233 and the cleaning means 1 (1*a* through 1*p*), respectively. Then, each flexible bending pipe 234 allows a movement of the associated cleaning means 1, such as when the printing cylinder such as plate cylinder or blanket cylinder is slightly and displacedly moved for printing preparation so that the cleaning means 1 is correspondingly required to be slightly displaced together with the mounting member S1 and supporting member S2 (see FIG. 2) supporting the cleaning means 1.

Each printing part is provided with the cleaning means 1 consisting of a group of four sets shown in FIG. 1, so that the first stage printing part is provided with cleaning means 1*a*, 1*b*, 1*c*, 1*d*. Similarly, the second stage printing part is provided with cleaning means 1*e*, 1*f*, 1*g*, 1*h*, the third stage printing part is provided with cleaning means 1*i*, 1*j*, 1*k*, 1*l*, and the fourth stage printing part is provided with cleaning means 1*m*, 1*n*, 1*o*, 1*p*.

The distributing valves 220 through 224 have the same interior structures, and there is exemplarily and preferably adopted an AUTO GREASTAR (Registered Trade-Mark in Japan) of Ishikawajima Hanyoki Service Co., Ltd. FIG. 5A through FIG. 7B are explanatory views showing phases where substantially equal amounts of liquid (i.e., cleaning solution) to be discharged are sequentially discharged from outlets of each distributing valve. Note, hatching is omitted from cross sections of the shown components in FIG. 5A through FIG. 7B, for expediting the explanation. Although the operation of the distributing valve 220 is representatively explained, the operation of the other distributing valves are apparently the same.

This distributing valve is of a plunger-pump type constituted such that each plunger is moved so that such an amount of cleaning solution corresponding to the moved stroke of the plunger is discharged from the associated one of outlets. This distributing valve includes three cylinder portions each incorporating therein a plunger. Designating each (hereinafter called "plunger pump") of the combinations of three plungers and associated cylinder portions as No. 1, No. 2 and No. 3, each of the No. 1 and No. 2 is provided with the plunger having stepped portions at two locations, while the No. 3 is provided with the plunger having stepped portions at three locations as you can see in FIG. 5A. It is particularly noted that, the No. 3 plunger pumps shown at both sides are just the same one, though four pieces of plunger pumps are shown in FIG. 5A through FIG. 7B for expediting the understanding.

Then, to be supplied into a filling port 225 shown in FIG. 5A through FIG. 7B is a cleaning solution pressurized by the pressure acted from the supplying pump of the supply source part 21 shown in FIG. 1.

In the first phase (FIG. 5A), the pressurized cleaning solution supplied from the filling port 225 passes through the No. 3 cylinder and an inclined passage 227*a* to thereby urge the No. 1 plunger in a thick arrow direction from the downside of the No. 1 plunger. This moves the No. 1 plunger upwardly, so that the cleaning solution within the cylinder above the No. 1 plunger is passed through an inclined passage 227*b*, the No. 3 cylinder and a by-pass 228*a* and then discharged from an outlet 229*a* by a ½ unit of discharging amount.

In the next second phase (FIG. 5B), the No. 2 plunger is operable. The pressurized cleaning solution supplied from the filling port 225 passes through: a path 226 communicated with the filling port 225; the No. 1 cylinder communicated with the path 226 by the movement of the No. 1 plunger in the first phase; and an inclined passage 227*c*; to thereby urge the No. 2 plunger in a thick arrow direction from the downside of the No. 2 plunger. This moves the No. 2 plunger upwardly, so that the cleaning solution within the cylinder above the No. 2 plunger is passed through an inclined passage 227*d*, the No. 1 cylinder and a by-pass 228*b* and then discharged from an outlet 229*b* by a ½ unit of discharging amount.

Similarly, in the third phase (FIG. 6A), the No. 3 plunger is operable. The pressurized cleaning solution supplied from the filling port 225 passes through: the path 226; the No. 2 cylinder communicated with the path 226 by the movement of the No. 2 plunger in the second phase; and an inclined passage 227*e*; to thereby urge the No. 3 plunger in a thick arrow direction from the downside of the No. 3 plunger. This moves the No. 3 plunger upwardly, so that the cleaning solution within the cylinder above the No. 3 plunger is passed through an inclined passage 227*f* and the No. 2 cylinder and then discharged from an outlet 229*c* by 1 unit of discharging amount.

In the fourth phase (FIG. 6B), the No. 1 plunger is operable. The pressurized cleaning solution supplied from the filling port 225 passes through: the filling port 225 itself; the No. 3 cylinder communicated with the filling port 225 by the movement of the No. 3 plunger in the third phase; and the inclined passage 227*b*; to thereby urge the No. 1 plunger in a thick arrow direction from the upside of the No. 1 plunger. This moves the No. 1 plunger downwardly, so that the cleaning solution within the cylinder below the No. 1 plunger is passed through the inclined passage 227*a*, the No. 3 cylinder and the by-pass 228*a* and then discharged from the outlet 229*a* by a ½ unit of discharging amount.

In the fifth phase (FIG. 7A), the No. 2 plunger is operable. The pressurized cleaning solution supplied from the filling port 225 passes through: the path 226; the No. 1 cylinder communicated with the path 226 by the movement of the No. 1 plunger in the fourth phase; and the inclined passage 227*d*; to thereby urge the No. 2 plunger in a thick arrow direction from the upside of the No. 2 plunger. This moves the No. 2 plunger downwardly, so that the cleaning solution within the cylinder below the No. 2 plunger is passed through the inclined passage 227*c*, the No. 1 cylinder and the by-pass 228*b*, and then discharged from the outlet 229*b* by a ½ unit of discharging amount.

In the sixth phase (FIG. 7B), the No. 3 plunger is operable. The pressurized cleaning solution supplied from the filling port 225 passes through: the path 226; the No. 2 cylinder communicated with the path 226 by the movement of the No. 2 plunger in the fifth phase; and the inclined passage 227*f*; to thereby urge the No. 3 plunger in a thick arrow direction from the upside of the No. 3 plunger. This moves the No. 3 plunger downwardly, so that the cleaning solution within the cylinder below the No. 3 plunger is passed through the inclined passage 227*e*, the No. 2 cylinder and an outlet 229*d* by 1 unit of discharging amount.

Thereafter, the sequence reverts to the first phase.

The distributing valve operates in the above manner, so that the provision of the cleaning solution supplying means 2 allows to operate the supplying pump 210 acting as the supply source part 21 to thereby feed the cleaning solution to all sets of cleaning means at the 4-fold stacked printing parts. This allows replenishment of cleaning solution in an extremely simple manner, thereby allowing to improve the working efficiency. Further, it becomes possible to exclude a burden of an operator, to thereby release the operator from troublesome and complicated operations.

As apparent from the above explanation, by utilizing the bearer cleaning apparatus according to the preferred embodiment of the present invention for wipingly cleaning bearers' peripheral surfaces by utilizing a cleaning solution, it becomes possible to replenish a plurality of cleaning members with the cleaning solution from a single location in an extremely simple manner upon replenishing the cleaning members with the cleaning solution, thereby achieving an improved working efficiency and excluding a burden of an operator, to thereby release the operator from troublesome and complicated operations.

Particularly, even in such a web press constituted of a plurality of longitudinally overlapped printing parts and capable of conducting multi color printing and which web press is recently practiced such as in newspaper printing so that the respective printing parts are not placed in the same floor, it becomes unnecessary for the operator to go up and down among different floors, thereby reducing the physical burden of the operator.

What is claimed is:

1. A bearer cleaning apparatus provided correspondingly to bearers provided at ends, respectively, of a printing cylinder of a printing machine, the apparatus comprising:

a plurality of sets of cleaning means each provided with a cleaning member supported in a manner capable of contacting with the bearers' peripheral surfaces, respectively; and a cleaning solution supplying means for supplying a cleaning solution to said cleaning members of said plurality of sets of cleaning means;

wherein said cleaning solution supplying means comprises: a supply source part of the cleaning solution; a supply branching part of the cleaning solution; and supplying conduits leading from said supply source part via said supply branching part up to said plurality of sets of cleaning means, respectively.

2. The bearer cleaning apparatus of claim 1, further comprising:

a supplying pump as said supply source part, said supplying pump being provided with a cleaning solution reservoir;

wherein said supply branching part comprises a distributing valve, and wherein said supplying conduits are constituted of a main pipe leading from said supplying pump to said distributing valve; and branch pipes extending from said distributing valve in the downstream directions, respectively.

3. The bearer cleaning apparatus of claim 2, wherein at least the downstream-most portions of said branch pipes are capable of flexibly bending.

4. The bearer cleaning apparatus of claim 2, wherein said distributing valve is of a plunger-pump type constituted such that a plunger is moved to thereby discharge, from the associated one of outlets, such an amount of cleaning solution corresponding to the moved stroke of said plunger.

5. The bearer cleaning apparatus of claim 4, wherein said distributing valve is incorporated therein with three cylinder portions each incorporated therein with said plunger, and wherein two of said three sets of plungers and cylinder portions include the same shape plungers each having stepped portions at two locations, and the remaining one of said three sets includes a plunger having stepped portions at three locations.

6. The bearer cleaning apparatus of claim 1, wherein each of said cleaning member provided to each of said plurality of sets of cleaning means is constituted to be stably urged by force applying means against a bearer to be wipedly cleaned.

7. The bearer cleaning apparatus of claim 6, wherein said cleaning means is mounted on a mounting seat disposed above a supporting member via an angle bracket of said force applying means.

8. The bearer cleaning apparatus of claim 7, wherein said angle bracket has an L-shape arranged to include a long edge having a downwardly directed tip end and a short edge projected oppositely to said supporting member, and said angle bracket is mounted to both of said supporting member and said mounting seat.

9. The bearer cleaning apparatus of claim 8, wherein said short edge of said angle bracket is formed with a pair of holes penetrating through said short edge parallelly to said long edge at positions slightly separated from said long edge, and these holes are inserted with a pair of shafts of said force applying means.

10. The A bearer cleaning apparatus of claim 9, wherein said pair of shafts have upper ends mutually coupled by a plate so that said pair of shafts are disposed to smoothly move when said pair of shafts are upwardly and downwardly operated, and wherein said shafts have lower ends fixed with an L-shaped block by means of setscrews.

11. The bearer cleaning apparatus of claim 10, wherein, between the lower surface of said short edge of said angle bracket and the upper surface of said short edge of said L-shaped block, said pair of shafts of said force applying means are fitted with compression springs thereon, respectively, of urging means for urging said cleaning member onto the outer periphery of the plate cylinder bearer (PB).

* * * * *